United States Patent [19]

Zerle

[11] Patent Number: 4,760,945

[45] Date of Patent: Aug. 2, 1988

[54] WEB-POSITION CONTROLLER

[75] Inventor: Ludwig Zerle, Mering, Fed. Rep. of Germany

[73] Assignee: Erhardt+Leimer GmbH, Augsburg, Fed. Rep. of Germany

[21] Appl. No.: 850,481

[22] Filed: Apr. 10, 1986

[30] Foreign Application Priority Data

Apr. 11, 1985 [DE] Fed. Rep. of Germany ..... 3512904

[51] Int. Cl.[4] ..... B65H 23/03; B65H 26/02

[52] U.S. Cl. ..... 226/18; 226/20

[58] Field of Search ..... 226/15, 18, 21, 20, 226/45, 1, 2

[56] References Cited

U.S. PATENT DOCUMENTS

| | | | |
|---|---|---|---|
| 3,368,726 | 2/1968 | Funk et al. | 226/20 X |
| 3,912,193 | 10/1975 | Calvaer | 226/20 X |
| 4,021,031 | 5/1977 | Meihofer et al. | 226/20 |
| 4,384,686 | 5/1983 | Wiley et al. | 226/20 X |

*Primary Examiner*—Stuart S. Levy

*Assistant Examiner*—Lynn M. Sohacki

*Attorney, Agent, or Firm*—Herbert Dubno

[57] ABSTRACT

A conveyor belt controller for controlling the variations in the lateral position of a running conveyor belt comprises a regulated stretch of conveyor belt having a guide member, particularly a guide roller, at one end, a controllable guiding mechanism able to laterally displace the conveyor belt when the conveyor belt is shifted from a correct position, and at least one video camera observing the lateral motion of the conveyor belt whose electrical image signal is convertable by a computer into a controlling command for the guiding mechanism. The video camera is mounted upstream from the guide member spaced approximately a distance equal to the length of the regulated stretch. An indicating member is provided in the image field of the video camera for the actual position of the guiding mechanism extending transversely to the guiding mechanism. Advantageously, the indicating member is provided with an indicator light source which is pulsed for more sensitive detection.

18 Claims, 2 Drawing Sheets

WEB-POSITION CONTROLLER

FIELD OF THE INVENTION

My present invention relates to a controller or regulating device for a web of material, and more particularly to a conveyor controller for regulating and adjusting a moving material web on its associated guide members to maintain a desired edge-true position of the web.

BACKGROUND OF THE INVENTION

A known controller for a web of material, in this case a metal strip, which regulates and controls the variations in the lateral position of a running material web comprises a regulated stretch of the material web having a guide member, especially a guide roller, at one end and a controllable guiding mechanism able to angularly divert the material web passing through the regulated stretch.

The control of the guiding mechanism depends on the angular displacement of the web control roller occuring in a guided segment of the material web adjacent the regulated stretch.

The guided segment of the material web passing over the guide member is deflected approximately at a right angle to the running direction of the regulated stretch. At least one video camera is provided for observing the edge motion and course of the material web: an electrical image signal from this camera is convertable by a computer into a controlling command for the guide mechanism and has an optical axis oriented approximately parallel to the regulated stretch of the material web.

This web-position controller is described in literature reference "VDI-Nachrichten, June, 1980, Nr. 23, Seite 16". In this known web-position controller the video camera is mounted downstream from the guide member. The guide member is formed as a guide roller and acts as a controlling roller for the course of the conveyor belt. The length of the regulated stretch and the viewing distance of the video camera to the guide member add to one another and lead to correspondingly larger structural measurements.

Each material web edge has its own camera. A light source illuminating the material web edge in reflected light or transmitted light can serve to light up the image field of the video camera. The electronic signal analyzer forms from both camera images an analog voltage corresponding to the material web position. The web-position controller opens a servovalve proportionally to the deviation of the material web from the proper line, which activates an adjusting cylinder causing a controlled pivoting of the controlling roller.

This pivoting leads to a lateral displacement of the material web until the belt is properly centered on the guide members.

OBJECTS OF THE INVENTION

It is the principal object of my invention to provide an improved material-web controller which overcomes drawbacks of earlier mechanisms for this purpose.

It is also an object of my invention to provide an improved material-web controller which is considerably shorter than known web-position controllers.

It is another object of my invention to provide a self-calibrating improved web-position controller which uses information provided by itself to establish the actual-value position of the guiding mechanism for the material web in the regulation and control process.

SUMMARY OF THE INVENTION

These objects and others which will become more readily apparent hereinafter are attained in accordance with my invention in a web-position controller comprising a regulated stretch of the material web having a guide member, particularly a guide roller, at one end and a controllable guiding mechanism able to laterally divert or displace the material web passing through the regulated stretch.

The control of the guiding mechanism depends on the lateral displacement of the material web occurring in a guided segment of the material web connected to the regulated stretch. The guided segment of the material web is oriented at right angles to the running direction of the regulated stretch after passing over the guide member.

At least one video camera whose optical axis is oriented approximately parallel to the regulated stretch monitors the lateral motion and course of the material web. A computer or control logic provides a controlling command to the guiding mechanism upon receiving an electrical image signal from the video camera.

According to my invention the video camera is mounted upstream from the guide member and is spaced from the guide member by a distance approximately equal to the length of the regulated stretch of the material web.

An indicating member for the actual position of the guiding mechanism is provided extending transversely to the guiding direction, which additionally contributes an indicator image signal to the electrical image signal of the video camera.

The indicator image signal of the indicating member can be used by the computer to provide information on the position of the guiding mechanism, so that a separate position signal device is not necessary. Thus, in a particularly easy manner the center and final positions of the guiding mechanism can be detected. Furthermore, the action of the conveyor controller can be influenced and changed depending on the position of the guiding mechanism. A warning signal can be easily produced which indicates when the guiding mechanism has reached its permissible final position or very close to it.

The optical axis of the video camera should run close to the guide member position at the end of the regulated stretch.

This is particularly true in high speed operation when a lateral material web displacement is necessary directly behind the guide member because of a necessarily short control cycle and fast video camera detection.

The video camera can be a matrix camera. However, on account of its simplicity in this embodiment of my invention, the video camera is a scanning linear column camera having a semiconductor image sensor in the form of a CCD-strip mounted transverse to the edge of the material web and its optical image. The CCD-strip is read out electronically in a known way and the signal produced is transmitted to the computer.

More specifically the invention comprises a device for laterally positioning a web of material traveling along a path which includes:

a deflecting roller having a nonpivotable axis for deflecting the web at a right angle to the path;

a pair of horizontally spaced regulating rollers mounted on a common support pivotable about an axis perpendicular to the rollers, the web passing over the regulating rollers parallel to the path over a regulating stretch;

a further deflecting roller having a nonpivotable axis for deflecting the web at a right angle from the stretch to the path, the web having a vertical stretch between the regulating stretch and the further deflecting roller;

a video camera trained on the vertical stretch and located beneath the regulating stretch and positioned so that the distance between the camera and the vertical stretch is a major fraction of the length of the regulating stretch;

an indicator connected to the frame in the field of view of the camera;

logic circuit means connected to the camera for processing electrical signals received therefrom; and control means connected to the logic circuit means and operatively connected to the frame for angularly displacing the frame in response to an image sensed by the camera to maintain edge true travel of the web along the path.

The indicator can be provided with a light emitter detectable by the camera.

Advantageously, the light emitter is connected with a pulsed electrical energizing source and the logic circuit means is responsive to pulsing cadence of the emitter.

Furthermore, the camera has an optical axis positioned proximal to the regulating roller which is relatively downstream along the regulating stretch.

The video camera can comprise a CCD strip extending transversely to an edge of the vertical stretch.

The device can also include an elongated light source extending transversely to an edge of the vertical stretch on a side thereof opposite that at which the video camera is disposed.

Advantageously, two video cameras with respective indicators are provided, each of the cameras being trained on a respective edge portion of the vertical stretch.

A support can be provided for the cameras disposed below the frame, the frame being rollingly carried by the support.

Advantageously, the axis perpendicular to the rollers is located at an upstream portion of the regulating stretch.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
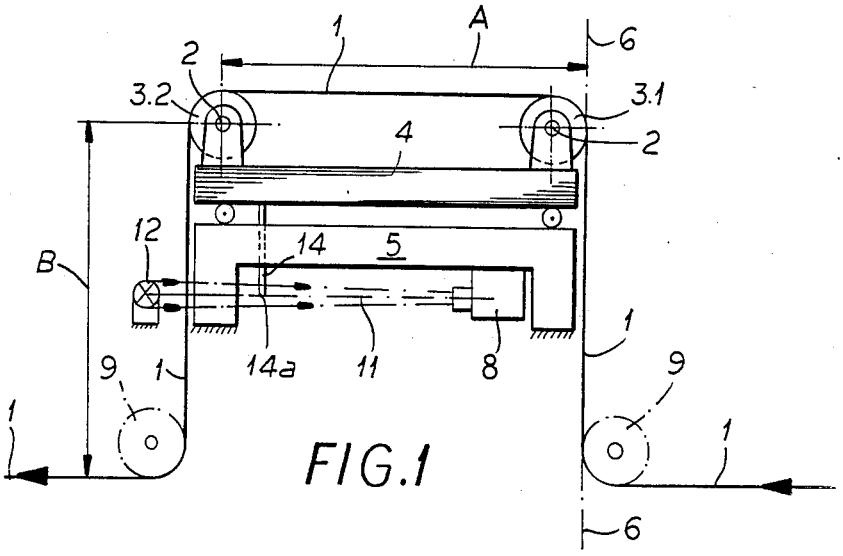
FIG. 1 is a side elevational view of one embodiment of a web-position controller according to my invention.

The web-position controller shown in the drawing has two guide members, in this case guide or regulating rollers 3.1 and 3.2 freely rotatable about parallel axes 2, for the material web 1. The web of material can be rolled metal strip, fabric, plastic (synthetic resin), extruded material or paper.

The material web 1 runs over the outer surface of these guide rollers, regulating rollers or guide members 3.1 and 3.2. The guide or regulating rollers 3.1 and 3.2 are mounted on a rotatable frame 4, which is pivotally mounted on a fixed frame 5 and which is pivotable about a pivot axis 6 of an adjusting or positioning drive 7.

The adjusting drive 7 is controlled by a video camera 8 to be described in greater detail below reacting to the lateral course and motion of the material web edge 13 which depends on the lateral displacement of the material web 1 below the second guide member or roller 3.2, in the rotatable frame 4.

In both the upstream and the downstream directions from the guide rollers 3.1 and 3.2 an additional guide roller 9 with a nonpivotable rotation axis is mounted. These fixed guide or deflecting rollers 9 do not take part in the adjusting motion of the rotatable frame 4. They guide the material web 1 over the guide rollers 3.1 and 3.2 of the rotatable frame 4 in a direction perpendicular to the plane of the material web 1 between both guide rollers 3.1 and 3.2 of the rotatable frame 4.

As a result both guide members or rollers 3.1 and 3.2 of the rotatable frame 4 form a running regulated stretch A of the material web 1 inside of which the rotatable frame 4 serving as part of a controllable guiding mechanism can laterally displace the material web 1. Thus, the control depends on the lateral displacement of the material web 1 in the guided segment B connected to the regulated stretch A between the guide roller 3.2 and the guide roller 9 having the fixed nonpivotable rotation axis.

In the guided segment B also the material web 1 is deflected about the second guide roller 3.2 of the rotatable frame 4 approximately at right angles to the direction it runs in the controlled stretch A.

Each video camera 8 detects at least one of the material web edges 13 or a guide line or marking 13*a* provided on the material web 1.

Thus each camera detects a line associated with an edge of the strip or band of material, i.e. either the respective edge itself or a marking line associated with the edge.

The electrical signal from the video camera 8 is fed to a controlling computer or logic circuit 10, in which it is converted into a command signal for the adjusting drive 7 of the guiding mechanism. The video camera 8 records all lateral movements of the material web edge 13.

The rotatable frame 4 of the adjusting drive 7 is pivoted so that the second guide member 3.2 of the rotatable frame 4 is pivoted in a direction opposite to that of the slipping or otherwise shifting material web 1. Thereby the material web 1 in the guided segment B between the guide rollers 3.2 and 9 is guided back into the position it is supposed to be in, i.e. its set-point position.

The video camera 8 is oriented with its optical axis 11 approximately parallel to material web 1 in the controlled stretch A between the guide rollers 3.1 and 3.2. It is mounted upstream of the guide roller 3.2 spaced a distance from the material web 1, which is approximately equal to the length of stretch A of the material web 1.

As a result, in this arrangement the length needed for the regulated stretch A is used completely for spacing the video camera 8 from the guide roller 3.2. Thus without additional space usage an increased spacing can be realized. This large spacing results in a correspondingly larger field of view for the video camera 8 in the plane of the material web 1 running in the guided segment B between the guide roller 3.2 and the guide roller 9.

In this embodiment the video camera 8 is a scanning line camera. Moreover it has a semiconductor image sensor 8*a* in the form of a charge-coupled device CCD-strip 8*a* oriented transverse to the optical image of the edge 13 of the material web 1 or the linear guide and readable into the computer or logic circuit 10. The edge 13 or the linear guide 13*a* detected by the video camera 8 is illuminated.

Transmitted light from a light source 12 behind the material web 1 as seen from the video camera 8 is used, and reaches over the entire image field width and thus illuminates this image field. The light source 12 may alternatively be positioned in the vicinity of the video camera 8 so that reflected light from the material web 1 is used.

A very wide material web 1 is shown in the example. The image field of a single video camera does not reach over the entire conveyor width. Thus each edge of the material belt 1 is provided with its own video camera 8, whose image signals are fed to the common computer 10. To be sure, the image fields of both cameras 8 can overlap in the center of the material web 1 so that an uninterrupted detection of the material web 1 is possible.

Figure 2:
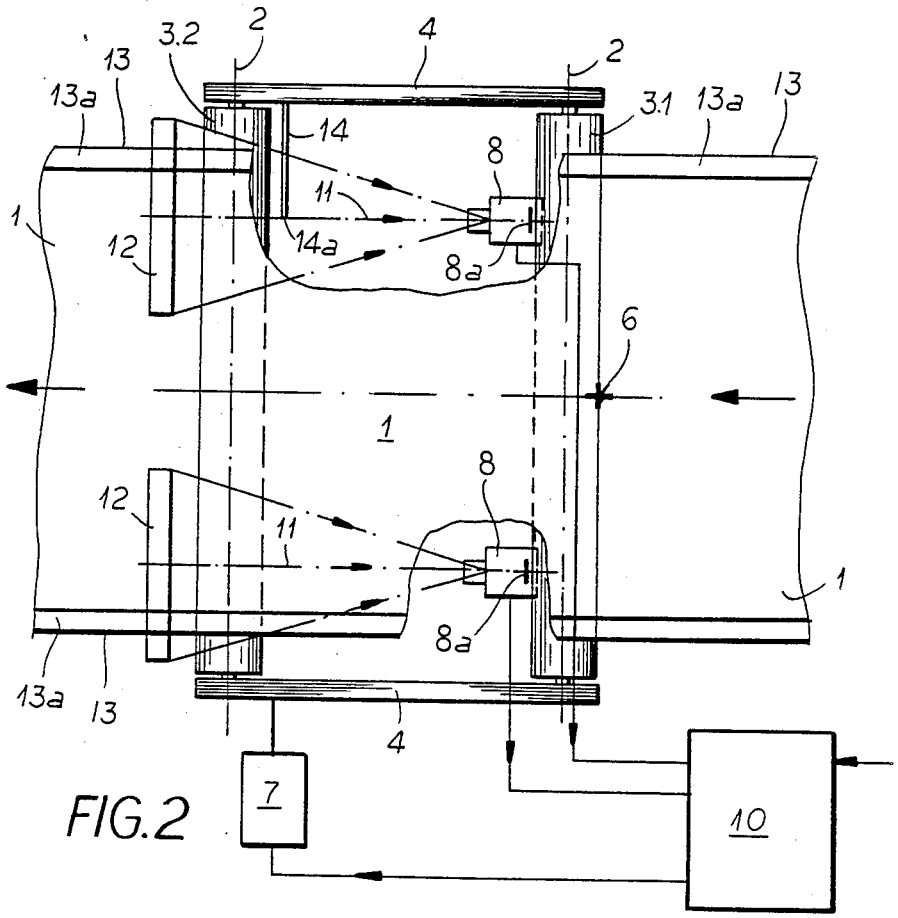
FIG. 2 is a top plan view of the web-position controller of FIG. 1.

In the image field of the video camera 8 shown in the top part of FIG. 2 an indicating member 14 is provided which extends transverse to the guide direction from the rotatable frame 4. The indicating member 14 is rigidly connected to the frame 4. The image of this indicating member 14 thus provides information on the position of the rotatable frame 4 relative to the position of the edge of the material web 1 or the linear guide 13*a*.

This indicating member 14 can carry its own indicator light source 14*a*, for example a light emitting diode or pulsed electrical energizing source 14*a*, or row of them, which can produce periodic light pulses. The computer 10 can detect a suitably pulsed image of the light source 14*a* on the indicating member 14. With that arrangement the indicating member 14 clearly is apparent against the signal background and its image can be easily distinguished from all of the background light and optical "noise" present in the environment.

According to the invention, the computer 10 renders it possible to guide the material web 1 according to either the positions of the edges 13 of the material web 1 or their linear guides 13*a*. Both of the edges 13 can be detected and used to ascertain the center position of the material web 1. Simultaneously the conveyor width is observed and indicated. Adjustments of the video cameras 8 for the conveyor width are not necessary on account of the size of their observation field. Simultaneously the position of the rotatable frame 4 is detected by the indicating member 14 and it can ascertain its pivot angle and produce a warning signal when the rotatable frame reaches its limiting or final position or a position just short of it.

Figure 3:
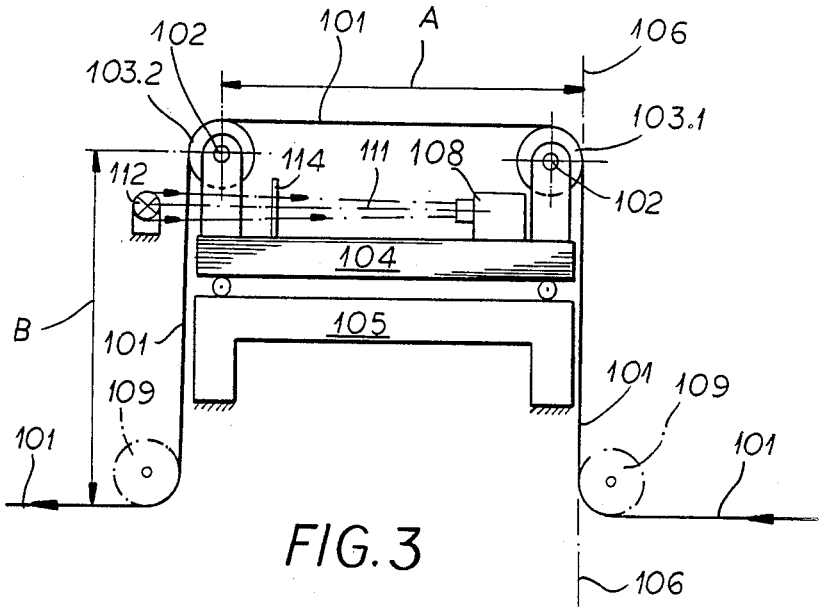
FIG. 3 is a side elevational view of another embodiment of a web-position controller according to my invention.

In the other embodiment of FIG. 3 the video camera 108 is mounted in relation to the rotatable frame 104, in this example, specifically on rotatable frame 104 in the vicinity of the first guide roller 103.1.

It is oriented with its optical axis 111 passing closely under the second guide member or roller 103.2 bounding the end of the regulated stretch A of the regulated stretch A so that the lateral position of the material web 101 is detected immediately after leaving guide roller 103.2.

Components of this embodiment which are similar in function to or identical to the components of the previous embodiment are labelled with reference characters which are 100 plus the reference character of the corresponding component in the previous embodiment. Other components and features of this embodiment are similar to those of the previous embodiment and are not separately described in detail here.

I claim:

1. In a web-position controller for regulating and controlling variations in the lateral position of a running conveyor belt comprising a regulated stretch of said material web having a guide member at one end and a controllable guiding mechanism able to laterally displace said material web passing through said regulated stretch, the control of said guiding mechanism depending on the lateral displacement of said material web occuring in a guided segment of said material web connected to said regulated stretch, said guided segment of said material web passing over said guide member, said guided segment being oriented approximately at a right angle to the running direction of said regulated stretch, at least one video camera whose optical axis is oriented approximately parallel to said regulated stretch of said material web, said camera having an image field within which is observed a lateral motion and course of said material web, said motion and course generating an electrical image signal in said camera, and a computer which converts said signal into a controlling command for said guiding mechanism, the improvement wherein said video camera is mounted upstream from said guide member, said camera being spaced approximately a distance equal to the length of said regulated stretch from said web as the web passes in front of as well as above the camera, and an indicating member transverse to said regulated stretch extending into an image field of said video camera provided for indicating the actual position of said guiding mechanism and thereby augmenting said electrical image signal.

2. The improvement according to claim 1 wherein said guide member is a guide roller.

3. The improvement according to claim 2 wherein said video camera detects the position of a linear guide mark on said material web.

4. The improvement according to claim 2 wherein said video camera detects the position of an edge of said material web.

5. The improvement according to claim 4 wherein an indicator light source is provided on said indicating member.

6. The improvement according to claim 5 wherein said indicator light source is pulsed and said computer receives a correspondingly pulsed image signal of said indicator light source.

7. The improvement according to claim 6 wherein said optical axis of said video camera runs close to said guide member positioned at said end of said regulated stretch.

8. The improvement according to claim 7 wherein said video camera includes a semiconductor image sensor in the form of a CCD-strip positioned transverse to said edge of said material web.

9. A web-position controller for regulating and controlling the variations in the lateral position of a running material web comprising:

(a) a regulated stretch of said material web, (b) a guide member for said material web positioned at one end of said regulated stretch, (c) a controllable guiding mechanism able to laterally displace said material web, (d) a guided segment of said material web, said segment being continuous with said regulated stretch, said segment passing over said guide member and being oriented at approximately a right angle to the running direction of said regulated stretch, (e) at least one video camera whose optical axis is oriented approximately parallel to said regulated stretch of said material web, said camera having an image field within which is observed a lateral course of said material web, (f) an electrical image signal generated by said observation of the lateral course of said material web, (g) a computer which converts said electrical image signal received from said video camera into a controlling command for said guiding mechanism, (h) an indicating member transverse to said regulated stretch and extending in the image field of said video camera for indicating the actual position of said guiding mechanism and thereby augmenting said electrical image signal, (i) a pulsed indicator light source mounted on said indicating member to help distinguish said indicating member from the optical background, and (j) a semiconductor image sensor in said video camera, said video camera being mounted upstream from said guide member spaced approximately a distance equal to the length of said regulated stretch, and being oriented so that the optical axis of said video camera runs close to said guide member below said guide member.

10. A device for laterally positioning a web of material traveling along a path, said device comprising:

a deflecting roller having a nonpivotable axis for deflecting said web at a right angle to said path;

a pair of horizontally spaced regulating rollers mounted on a common support pivotable about an axis perpendicular to said rollers, said web passing over said regulating rollers parallel to said path over a regulating stretch;

a further deflecting roller having a nonpivotable axis for deflecting said web at a right angle from said stretch to said path, said web having a vertical stretch between said regulating stretch and said further deflecting roller;

a video camera trained on said vertical stretch and located beneath said regulating stretch and positioned so that the distance between said camera and said vertical stretch is a major fraction of the length of said regulating stretch, said camera having an image field within which is observed a lateral motion of said material web;

an electrical image signal generated in said camera from observation of said lateral motion;

an indicator connected to said support transverse to said regulating stretch and extending into said image field of said camera thereby augmenting said electrical signal and provided for indicating an actual position of said support;

logic circuit means connected to said camera for processing said electrical image signal received therefrom; and control means connected to said logic circuit means and operatively connected to said frame for angularly displacing said support.

11. The device defined in claim 10 wherein said indicator is provided with a light emitter detectable by said camera.

12. The device defined in claim 11 wherein said light emitter is connected with a pulsed electrical energizing source and said logic circuit means is responsive to pulsing cadence of said emitter.

13. The device defined in claim 10 wherein said camera has an optical axis positioned proximal to the regulating roller which is relatively downstream along said regulating stretch.

14. The device defined in claim 10 wherein said video camera comprises a CCD strip extending transversely to an edge of said vertical stretch.

15. The device defined in claim 10, further comprising an elongated light source extending transversely to an edge of said vertical stretch on a side thereof opposite that at which said video camera is disposed.

16. The device defined in claim 15 wherein two video cameras with respective said indicators are provided, each of said cameras being trained on a respective edge portion of said vertical stretch.

17. The device defined in claim 16, further comprising a support for said cameras disposed below said frame, said frame being rollingly carried by said support.

18. The device defined in claim 17 wherein said axis perpendicular to said rollers is located at an upstream portion of said regulating stretch.

* * * * *